US007108570B2

(12) United States Patent
Okuyama

(10) Patent No.: US 7,108,570 B2
(45) Date of Patent: Sep. 19, 2006

(54) WATERCRAFT CONTROL SYSTEM FOR WATERCRAFT HAVING MULTIPLE CONTROL STATIONS

(75) Inventor: Takashi Okuyama, Hamamatsu (JP)

(73) Assignee: Yamaha Marine Kabushiki Kaisha, Shizouka-ken (JP)

( * ) Notice: Subject to any disclaimer, the term of this patent is extended or adjusted under 35 U.S.C. 154(b) by 279 days.

(21) Appl. No.: 10/293,403

(22) Filed: Nov. 12, 2002

(65) Prior Publication Data

US 2003/0092331 A1 May 15, 2003

(30) Foreign Application Priority Data

Nov. 12, 2001 (JP) ..... 2001-346076

(51) Int. Cl.
*B60K 41/00* (2006.01)

(52) U.S. Cl. ..... 440/84; 74/480 R

(58) Field of Classification Search ..... 440/84; 74/480 R

See application file for complete search history.

(56) References Cited

U.S. PATENT DOCUMENTS 4,020,713 A * 5/1977 Cantley et al. ..... 74/490.14
4,435,961 A 3/1984 Stewart
4,649,708 A 3/1987 Fisher
4,692,918 A 9/1987 Elliott et al.
4,817,466 A 4/1989 Kawamura et al.
4,836,809 A 6/1989 Pelligrino
4,850,906 A 7/1989 Kanno
5,031,562 A 7/1991 Nakase et al.
5,175,481 A 12/1992 Kanno
5,214,977 A * 6/1993 Nagafusa ..... 74/480 B
5,230,643 A 7/1993 Kanno
5,318,466 A * 6/1994 Nagafusa ..... 440/86
5,352,138 A 10/1994 Kanno
5,481,261 A 1/1996 Kanno
5,904,604 A 5/1999 Suzuki et al.
6,655,309 B1 * 12/2003 Stephens ..... 114/144 A

OTHER PUBLICATIONS

U.S. patent application Ser. No. 10/251,722, filed Sep. 20, 2002, entitled "Engine Control System For Watercraft," inventor, Isao Kanno.
U.S. patent application Ser. No. 10/247,919, filed Sep. 20, 2002, entitled "Inspection System For Watercraft," inventors, Takashi Okuyama, Isao Kanno.
U.S. patent application Ser. No. 10/255,042, filed Sep. 25, 2002, entitled "Diagnostic System For Watercraft," inventors, Isao Kanno, Hitoshi Motose.
U.S. patent application Ser. No. 10/254,818, filed Sep. 25, 2002, entitled "Watercraft Management System," inventors, Takashi Okuyama, Hitoshi Motose.
U.S. patent application Ser. No. 10/280,262, filed Oct. 24, 2002, entitled "Watercraft Control Systems," inventors, Isao Kanno, Takashi Okuyama.
U.S. patent application Ser. No. 10,281,390, filed Oct. 24, 2002, entitled "Small Watercraft and Outboard Motor," inventor Isao Kanno.

(Continued)

*Primary Examiner*—Jesus D. Sotelo
(74) *Attorney, Agent, or Firm*—Knobbe, Martens, Olson & Bear, LLP

(57) ABSTRACT

A watercraft control system for a watercraft having multiple control stations routes operation control signals in a non-competing, non-contradictory manner. In an embodiment, the control system includes a plurality of links. When abnormalities affect one or more of the communication links, the control system maintains communication through one or more of the unaffected communication links.

20 Claims, 12 Drawing Sheets

OTHER PUBLICATIONS

NMEA 2000; Standard for Serial Data Networking of Marine Electronic Devices; Main Document; Version 1.000, Sep. 12, 2001; @NMEA 1999, 2000, 2001.
NMEA 2000; Standard for Serial Data Networking of Marine Electronic Devices; Appendix A; Version 1.000; Sep. 12, 2001; @NMEA 1999, 2000, 2001.
NMEA 2000; Standard for Serial Data Networking of Marine Electronic Devices; Appendix B; @NMEWA 1999, 2000, 2001.
NMEA 2000; Standard for Serial Data Networking of Marine Electronic Devices; Appendix C; Version 1.000, Sep. 12, 2001, @NMEA 1999, 2000, 2001.
NMEA 2000; Standard for Serial Data Networking of Marine Electronic Devices; Appendix E; ISO 11783–5 Network Management.
NMEA 2000; Standard for Serial Data Networking of Marine Electronics Devices; Appendix G; ISO 11898 Controller Area Network.

* cited by examiner

FIG. 3

| | |
|---|---|
| Primary Control Station | Active |
| Secondary Control Station | Inactive |

FIG. 4

<table>
<tr><td colspan="2">Communication State<br>(Normal/Abnormal)</td></tr>
<tr><td rowspan="2">Communication<br>Links</td><td>Normal: Primary Bus</td></tr>
<tr><td>Abnormal: Local Bus</td></tr>
</table>

FIG. 5

| Communication State (Normal/Abnormal) | |
|---|---|
| Communication Links | Normal: Primary Bus |
| | Abnormal: Local Bus |
| Transfer Enable/ Disable | Normal: Transfer Enabled |
| | Abnormal: Transfer Disabled |

FIG. 6

| Communication State (Normal/Abnormal) | |
|---|---|
| Communication Links | Normal: Local Bus |
| | Abnormal: Secondary Bus |
| Transfer Enable/ Disable | Normal: Transfer Disabled |
| | Abnormal: Transfer Enabled |

FIG. 7

| Communication State (Normal/Abnormal) | |
|---|---|
| Communication Links | Normal: Primary Bus |
| | Abnormal: Secondary Bus |

WATERCRAFT CONTROL SYSTEM FOR WATERCRAFT HAVING MULTIPLE CONTROL STATIONS

REFERENCE TO RELATED APPLICATION

The present application claims priority benefit under 35 U.S.C. §119 from Japanese Patent Application No. 2001-346076, filed Nov. 12, 2001, entitled "Outboard Motor Operation Device, Outboard Motor Operation System, Method of Switching Boat Operation, Outboard Motor, and Inboard Network System," which is incorporated herein by reference.

BACKGROUND OF THE INVENTION

1. Field of the Invention

The present invention relates in to general to watercraft control systems and, in particular, relates to watercraft control systems that communicate over a network.

2. Description of the Related Art

Watercraft generally include operational and other controls that are used for maneuvering and other operations. For example, a watercraft often includes output control and steering control for a propulsion device, such as an inboard motor or an outboard motor having a propulsion mechanism, such as a jet, a propeller or another thrust generating device. In the past, the foregoing controls included mechanically linked devices. More recent control mechanisms employ one or more electronic systems. For example, the electronic systems may include an inboard local area network (LAN) that electrically connects, for example, a control station to the motor controls of an outboard motor. The inboard LAN may also connect other devices to one or more communication cables between the control station and the outboard motor.

The known electronic systems include a number of drawbacks when, for example, the watercraft includes multiple sets of operational controls. For example, a watercraft may include a plurality of control stations, each having a corresponding set of operational or other controls usable to maneuver or otherwise operate the watercraft. When such multi-set operational controls are operated simultaneously, the controls may send competing and even contradictory signals to the motor control via the inboard LAN. Consequently, the watercraft may not operate or may operate incorrectly.

In addition to the drawbacks associated with multi-set controls, the known electronic systems may fail when, for example, abnormal conditions affect communication in the inboard LAN. For example, electric shorts, poor connections, or the like may create communication breaks between nodes of the inboard LAN.

SUMMARY OF THE INVENTION

A need exists for a control system that provides electronic communication between components in a watercraft having a plurality of control stations. Moreover, a need exists for a control system that provides redundant communication channels and active routing mechanisms to overcome failure of portions of the system. Accordingly, embodiments in accordance with aspects of the invention described herein include a watercraft comprising a plurality of control stations that electronically communicate operational controls to a motor control such as an electronic control unit (ECU). Preferably, the control system stores information designating which of the plurality of control stations is authorized to maneuver or otherwise control the watercraft. Preferably, the control system includes a plurality of communication links and stores information designating one or more active communication links. Thus, when the control system determines that a communication link has failed, the control system uses the routing information to route communication through other available links.

One aspect of embodiments in accordance with the present invention is a watercraft control system for controlling a watercraft that has a motor and multiple control stations. The watercraft control system comprises a first control station and a second control station. The first control station comprises at least one memory that stores authorization information designating whether the first control station is authorized to control the watercraft. The first control station also comprises a first set of operational controls that output one or more operational control signals when the first control station is authorized to control the watercraft. The second control station comprises at least one memory that stores authorization information designating whether the second control station is authorized to control the watercraft. The second control station also comprises a second set of operational controls that output one or more operational control signals when the second control station is authorized to control the watercraft. The watercraft control system further comprises a motor controller that receives operational control signals from the authorized one of the first control station and the second control station and that controls the motor in response to the operational control signals. In preferred embodiments, when the authorization information stored in the at least one memory of the second control station designates authority for the first control station to operate the watercraft, the second control station disables the output of the one or more operational control signals of the second set of operational controls. Also in preferred embodiments, when the authorization information stored in the at least one memory of the first control station designates authority for the second control station to operate the watercraft, the first control station disables the output of the one or more operational control signals of the first set of operational controls. The first set of operational controls advantageously includes a start/stop control, a throttle/shift control, and a steering control. In particularly preferred embodiments, the watercraft control system further comprises a first communication link that provides communication of the operational control signals of the controls of the control stations and a second communication link that provides communication of the operational control signals of the controls of the control stations. When at least one operational control in the first set of operational controls receives an abnormal signal via the first communication link, the at least one operational control switches communication to the second communication link in response to the receipt of the abnormal signal.

Another aspect of embodiments in accordance with the present invention is a watercraft motor control system that routes communication around improperly operating communication links in a watercraft having a motor. The watercraft control system comprises a first set of controls that outputs signals and an electronic control unit (ECU) in the motor. The ECU receives the signals and controls the motor in response to the signals. A first communication link couples the signals from the first set of controls to the ECU during normal communication conditions. A second communication link selectively couples the signals from the first set of controls to the ECU when a control in the first set of controls determines that communication to or from the ECU via the first communication link is abnormal and switches communication to the second communication link. In preferred embodiments, the first set of controls includes at least one memory that stores routing information. The routing information includes routing instructions when communication is normal and routing instructions for when communication is abnormal. In particular embodiments, the watercraft control system further comprises a second set of controls that communicate with the ECU via the first communication link or via the second communication link. In such particular embodiments, the watercraft control system further comprises at least one memory that stores authorization information to designate either the first set of controls or the second set of controls as being authorized to communicate signals to operate the watercraft.

Another aspect of embodiments in accordance with the present invention is a watercraft control system for a watercraft that has a first operator control station and a second operator control station. The watercraft control system comprises a first control station selector. A first set of one or more watercraft operational controls at the first control operator control station is enabled to send one or more control signals when the first control station selector is activated. A second set of one or more watercraft operational controls at the second operator control station is disabled from sending control signals when the first control station selector is activated.

Another aspect of embodiments in accordance with the present invention is a method of authorizing one of a plurality of sets of controls for a watercraft having a first control station and a second control station. The method comprises receiving electronic data identifying one of the plurality of sets of controls authorized to operate a watercraft; storing the data; determining, based on the stored data, whether a received operation control signal from the plurality of sets of controls is from the authorized one of the plurality of sets of controls; and operating the watercraft when the received operation control signal corresponds with the authorized one of the plurality of sets of controls.

Another aspect of embodiments in accordance with the present invention is a watercraft control system for routing communication. The control system comprises a watercraft operational control coupled to two or more communication links. The control system further comprises a memory that identifies one of the two or more communications links as active when an abnormality is detected in another of the two or more communication links.

Another aspect of embodiments in accordance with the present invention is a method for routing communication in a watercraft control system. The method comprises detecting an abnormality in a first communication link coupled to one or more watercraft controls; storing information indicating that an abnormality has occurred in the first communication link; and routing communication to a second communication link on the basis of the information.

BRIEF DESCRIPTION OF THE DRAWINGS

Preferred embodiments in accordance with aspects of the present invention are described below in connection with the attached drawing figures, in which:

FIG. 3 illustrates an exemplary information block comprising control state information usable by the control system of FIG. 2 to determine which control station has authorization to operate the watercraft of FIG. 1;

FIG. 4 illustrates an exemplary information block comprising communication routing information usable by the start/stop controls of FIG. 2 to route communication via multiple communication links according to a given communication state;

FIG. 5 illustrates an exemplary information block comprising communication routing information usable by the throttle/shift controls of FIG. 2 to route communication via multiple communication links and to enable or disable signal transfer functionality according to a given communication state;

FIG. 6 illustrates an exemplary information block comprising communication routing information usable by the steering controls of FIG. 2 to route communication via multiple communication links and to enable or disable signal transfer functionality according to a given communication state;

FIG. 7 illustrates an exemplary information block comprising communication routing information usable by the ECU of FIG. 2 to route communication via multiple communication links according to a given communication state;

DETAILED DESCRIPTION OF THE PREFERRED EMBODIMENT

An embodiment of the invention includes a watercraft control system for a watercraft that has a plurality of control stations. Authorization to operate the watercraft can be switched among the plurality of control stations, and in a preferred embodiment, communication from unauthorized control stations is disabled.

A further embodiment of the invention includes a watercraft control system, where communication is routed around abnormalities to one or more of the unaffected communication routes. In one embodiment, the determination whether an abnormality has occurred in one or more communication routes is based on the presence or absence of a received signal. For example, an open circuit, a short circuit, or the like can be determined by interrupted transmission from a motor or by the distortion of a signal waveform. In one embodiment, a plurality of the watercraft control devices are connected to each other through a primary bus network and a secondary bus network. When the primary network bus operates properly, the watercraft control devices may advantageously communicate among one another through the primary bus network. When the primary bus network fails, the watercraft control devices may advantageously communicate among one another through the secondary bus network.

To facilitate a more complete understanding of the invention, the remainder of the detailed description describes the invention with reference to the figures.

Figure 1:
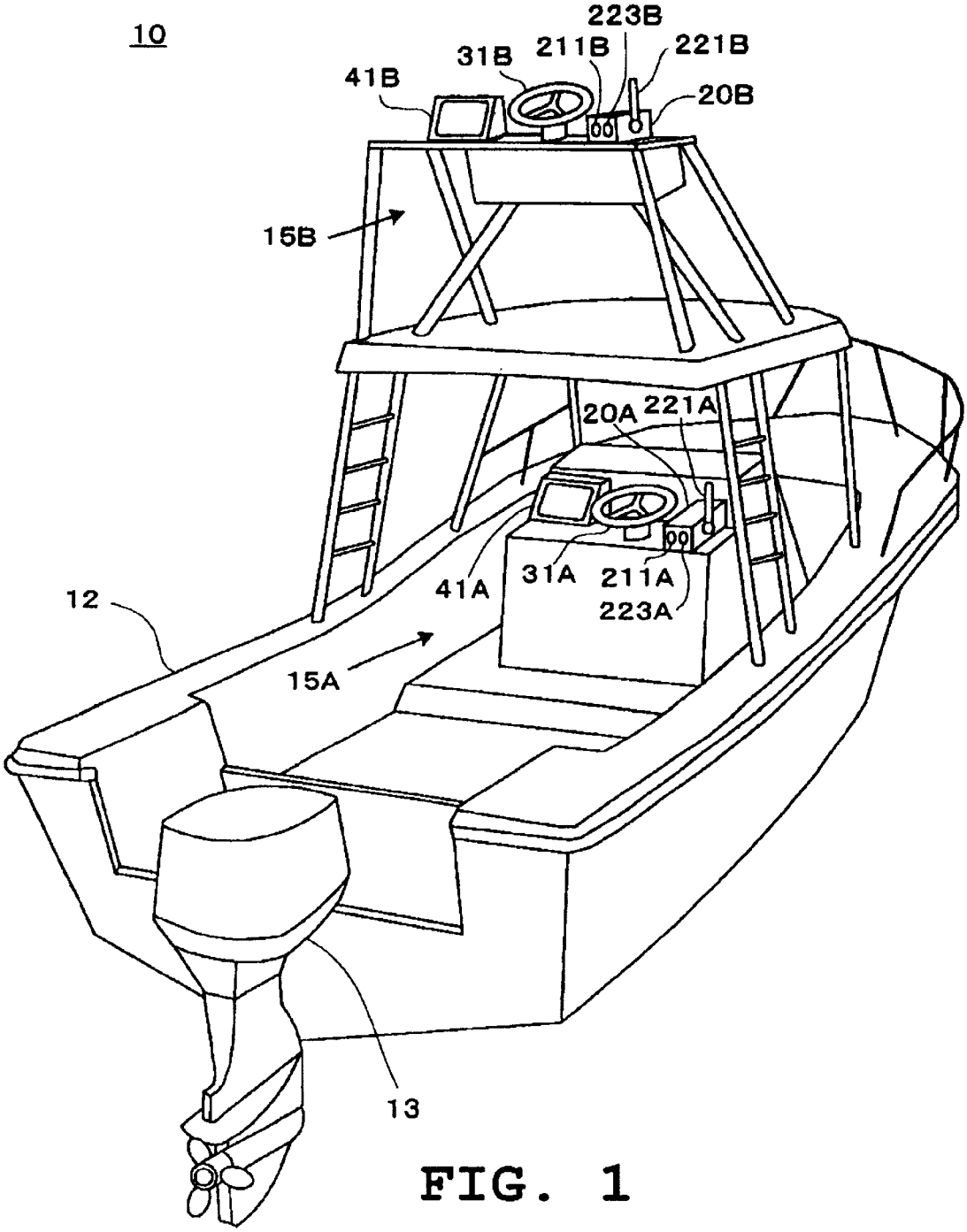
FIG. 1 is a perspective rear view of a watercraft in accordance with an embodiment of the invention.

FIG. 1 illustrates a watercraft in accordance with an embodiment of the invention. As shown in FIG. 1, the watercraft 10 includes a hull 12, a motor 13, a primary control station 15A and a secondary control station 15B. Each of the primary control station 15A and the secondary control station 15B includes an associated set of operational controls that send operational control signals to other devices (e.g., the motor 13) to control the operation of the watercraft 10.

The motor 13 generally includes an electronic control unit (ECU) (not shown) that receives the operational control signals and controls the operations performed by the motor in response to the received operational control signals. The motor operations include, for example, changing the speed, changing the steering direction, adjusting the power output, adjusting the trim, or the like. Manipulation of one of the sets of operational controls is converted to an operational control signal, which is transferred over a communication network (not shown in FIG. 1) to the motor 13. The ECU of the motor 13 converts the operational control signals to actuation commands within the motor 13, and the motor 13 changes operational conditions in response to the actuation commands.

Although the watercraft 10 is disclosed with reference to its preferred embodiment, the invention is not intended to be limited thereby. Rather, the disclosure herein will enable a skilled artisan to recognize a wide number of alternatives for the watercraft 10. For example, the watercraft 10 may be any watercraft, including but not limited to a boat, personal watercraft, yacht, or the like. A skilled artisan will also recognize from the disclosure herein a wide number of alternatives for the hull 12, the motor 13, and the control stations 15A and 15B.

In FIG. 1 the primary control station 15A comprises a display 41A, a steering device 31A such as a steering wheel or the like, a control unit 20A, a start/stop switch 211A, a throttle/shift lever 221A, and a control station selector 223A. The foregoing components are operable to control the watercraft. For example, operation of the start/stop switch 211A sends one or more operational control signals to the ECU of the motor 13 to start and stop the motor 13. Operation of the throttle/shift lever 221A sends one or more operational control signals to the ECU of the motor 13 to control whether the watercraft 10 advances (moves forward) or reverses (moves backward) and to control the speed of the watercraft 10. Operation of the steering device 31A sends one or more operational control signals to the ECU of the motor 13 to control the direction of the thrust generated by the propulsion device (e.g., the propeller) to control whether the watercraft continues along a current path or deviates to the left or the right.

Operation of the control station selector 223A advantageously enables the foregoing set of controls at primary control station 15A. Consequently, when the control station selector 223A is operated, the watercraft 10 may be maneuvered or otherwise controlled by an operator at primary control station 15A.

The secondary control station 15B includes components corresponding to at least some of the components of the primary control station 15A. In particular, the secondary control station 15B includes a control station selector 223B. When the control station selector 223A is operated to enable the set of controls at primary control station 15A, the control station selector 223B advantageously disables the set of controls at the secondary control station 15B. Similarly, operation of the control station selector 223B to enable the set of controls at the secondary control station 15B advantageously disables the set of controls at primary control station 15A. Thus, competing and contradictory control signals from multiple control stations are avoided.

Based on the foregoing, the watercraft 10 includes a control system that advantageously enables multi-station control using, for example, the control station selectors, 223A and 223B, of the control stations 15A and 15B, respectively.

Figure 2:
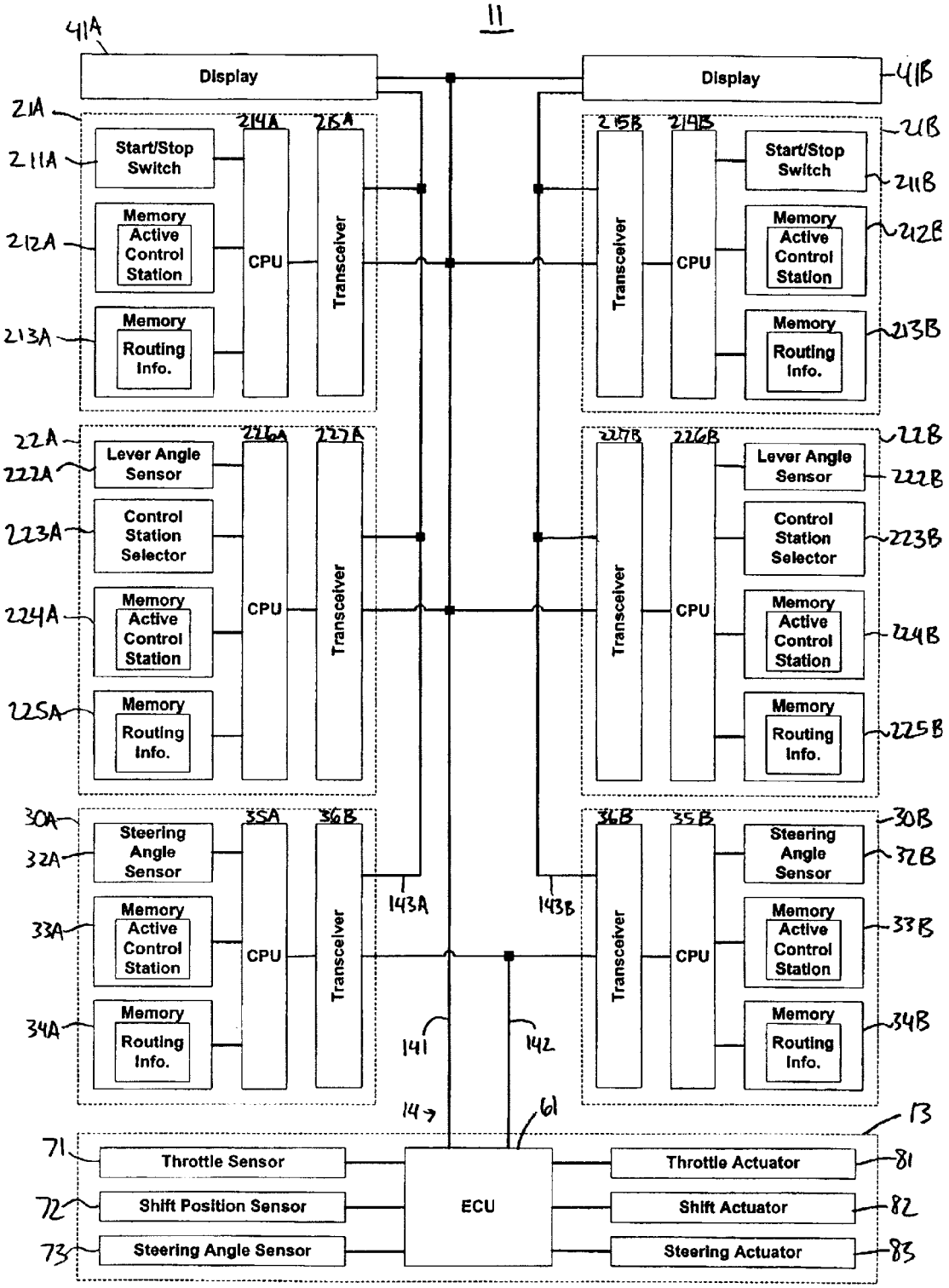
FIG. 2 is a block diagram of an embodiment of a control system for the watercraft of FIG. 1 wherein the system provides multiple communication links and multiple control stations.

FIG. 2 illustrates an embodiment of a control system 11 for the watercraft of FIG. 1. The control system 11 connects the foregoing sets of operational controls and displays of control stations 15A and 15B through a plurality of communication links, such as a local area network (LAN) 14. For example, the LAN 14 advantageously includes a primary bus 141 that connects the displays 41A and 41B, the start/stop controls 21A and 21B, the throttle/shift controls 22A and 22B, and an ECU 61 of the motor 13 in a bus network arrangement. The foregoing controls send control signals to the ECU 61 and receive, for example, display information from the ECU 61 via the primary bus 141.

In the embodiment illustrated in FIG. 2, the LAN 14 further includes a secondary bus 142 that interconnects the ECU 161, the steering control 30A of the primary control station 15A and the steering control 30B of the secondary control station 15B. The use of the secondary bus 142 is described below.

As further illustrated in FIG. 2, the LAN 14 advantageously includes a local bus 143A that interconnects the controls of the primary control station 15A and a local bus 143B that interconnects the controls of the secondary control station 15B. In particular, the local bus 143A connects the start/stop control 21A, the throttle/shift control 22A, the display 41A and the steering control 30A in a bus network arrangement. The local bus 143B connects the start/stop control 21B, the throttle/shift control 22B, the display 41B and the steering control 30B in a bus network arrangement.

The LAN 14 and the buses 141, 142 and 143 may advantageously comprise any suitable combination of wired connections or wireless connections. For example, the LAN 14 and the buses 141, 142 and 143 may comprise wired connections, infrared connections, radio connections, ultrasonic connections or the like.

The control system 11 illustrated in FIG. 2 advantageously provides multiple communication links to route around bus failures. For example, as described below, when the primary bus 141 fails, communication between the ECU 61 and the controls is advantageously rerouted using the secondary bus 142 and the local buses 143A and 143B.

The start/stop controls 21A and 21B illustrated in FIG. 2 advantageously output respective start/stop signals to control the starting and the stopping of the engine of the motor 13. For example, operation of an enabled start/stop switch 211A or an enabled start/stop switch 211B sends a respective start signal or a respective stop signal from the enabled start/stop control 21A or 21B.

The start/stop control 21A preferably includes a memory 212A that stores information, such as the information shown in an information block in FIG. 3. In particular, the stored information identifies which of the control station 15A or the control station 15B is authorized (e.g., enabled) to control the watercraft 10. For example, when the information stored in the memory 212A indicates the control station 15A is inactive (e.g., not authorized to control the watercraft 10), the start/stop control 21A is disabled. In this example, a memory 212B of the startup/stop control 21B stores information indicating that the start/stop control 21B is enabled and that the control station 15B is active (e.g., authorized to control the watercraft 10).

Preferably, operation of the control station selector 223A or the control station selector 223B changes the active control station information in the memory 212A and a memory 212B, thereby changing the active control station to an inactive status and changing the inactive control station to an active status. In alternative embodiments, other suitable methods can be used to determine whether or not a control station is authorized to operate the watercraft 10.

Preferably, the start/stop control 21A also includes a memory 213A that stores information that designates routing information, such as, for example, information that identifies the links available for communication to and from the start/stop control 21A. For example, FIG. 4 illustrates exemplary routing information stored in the memory 213A. The top row of FIG. 4 illustrates information representing whether the communication state of the start/stop control 21A is normal or abnormal. The second and third rows of FIG. 4 associate the two communication states with corresponding available communication routes or links (e.g., the primary bus 141, or the local bus 143A). In particular, in the illustrated embodiment, when the communication state is normal, the communication link is the primary bus 141, and when the communication state is abnormal, the communication link is the local bus 143A.

Preferably, the start/stop control 21A determines whether its communication state is normal or abnormal using any suitable criteria, including, but not limited to, the normality of signals received or monitored by the start/stop control 21A. For example, when the start/stop control 21A receives a signal from the ECU 61 that is either interrupted or has a distorted waveform, the start/stop control 21A advantageously changes its communication state to abnormal. Similarly, when the signal from the ECU 61 is uninterrupted and has a clean waveform, the start/stop control 21A can change its communication state to normal. Consequently, the start/stop control 21A outputs control signals to the primary bus 141 when the start/stop control 21A determines that its communication state is normal. Moreover, the start/stop control 21A outputs control signals to the local bus 143A when the start/stop control 21A determines that its communication state is abnormal. In other embodiments, the routing information may comprise any number of suitable communication states and destinations.

The memories 212A and 213A advantageously comprise suitable memory devices (e.g. RAM, ROM, flash memory, or an auxiliary memory device such as a hard disk, a CD-ROM or the like) that can preferably sustain the memory contents after control system 11 shuts down (e.g., non-volatile). Although shown as separate memory devices in FIG. 2, it will be understood by one skilled in the art that the memories 212A and 213A may advantageously comprise different blocks of storage locations in a common memory device.

As further illustrated in FIG. 2, the start/stop control 21A also comprises a CPU 214A and a transceiver 215A. The CPU 214A advantageously comprises a central processing unit, such as a microprocessor or microcontroller, a programmed circuit, or the like, that manages the operation of the start/stop control 21A. For example, the CPU 214 advantageously manages the generation of the output of the control signals on the basis of the active control station information stored in the memory 212A. Additionally, the CPU 214A advantageously changes the destination of control signals on the basis of the routing information stored in the memory 213A. The transceiver 215A is configured to communicate with the primary bus 141 and with the local bus 143A.

As shown in FIG. 2, the start/stop control 21B includes at least some of the components corresponding to the components of the start/stop control 21A, and like components are labeled with the same numeric identifiers with the suffixes changed from "A" to "B." The components of the start/stop control 21B perform the functions described above with reference to corresponding components of the start/stop control 21A.

An enabled one of the throttle/shift controls 22A and 22B illustrated in FIG. 2 advantageously outputs, for example, a throttle control signal (e.g., a throttle opening signal) and a shift control signal (e.g., a shift position signal). The control signals are communicated to the ECU 61 via the primary bus 141 or via the local bus 143 and the secondary bus 142. For example, when the control station 15A is enabled, operation of the throttle/shift lever 221A is detected by a lever angle sensor 222A, which sends control signals from the throttle/shift control 22A to the ECU 61. The lever angle sensor 222A advantageously detects angles, or inclinations, of the throttle/shift lever 221A. In this example, when the throttle/shift lever 221A is moved toward the bow beyond a predetermined angle from a neutral position, the propeller generates forward thrust to move the watercraft 10 ahead. When the throttle/shift lever 221A is moved toward the stern, the motor 13 shifts and the rotational direction of the propeller changes to generate reverse thrust to move the watercraft 10 backward. When the throttle/shift lever 221A is declined toward the bow or toward the stern beyond a predetermined angle, the throttle opens gradually to increase the rotational speed of the propeller to thereby increase the watercraft speed. In other embodiments, any suitable method can be used to advance, to reverse, to increase the speed of, or to decrease the speed of the watercraft 10.

In the illustrated embodiment, the throttle/shift control 22A includes a memory 224A that stores information, such as the information shown in the information block in FIG. 3. As discussed above, the stored information identifies which of the primary control station 15A or the secondary control station 15B is authorized to control the watercraft 10. For example, when the information stored in the memory 224A indicates the primary control station 15A is inactive (e.g., not authorized to control the watercraft 10), the throttle/shift control 22A is disabled. In this example, a memory 224B of the throttle/shift control 22B stores information indicating that the throttle/shift control 22B is enabled and that the secondary control station 15B is active (e.g., authorized to control the watercraft 10). Preferably, operation of the control station selector 223A or the control station selector 223B changes the active control station information in the memory 224A and the memory 224B, thereby selecting the control station to designate as the active control station. In alternative embodiments, other suitable methods can be used to determine whether or not a control station is authorized to operate the watercraft 10.

Preferably, the throttle/shift control 22A also includes a memory 225A that stores information designating routing information, such as, for example, information that identifies the links available for communication to and from the throttle/shift control 22A. For example, FIG. 5 illustrates exemplary routing information stored in an information block in the memory 225A. The top row of FIG. 5 illustrates information representing whether the communication state of the throttle/shift control 22A is normal or abnormal. The second row associates the communication link to and from the throttle/shift control 22A with the primary bus 141 when the communication state is normal, and the third row associates the communication link with the local bus 143A when the communication state is abnormal. The fourth and fifth rows associate a transfer state of the throttle/shift control 22A with the communication state. In particular, as indicated in the fourth row, when the communication state is normal, the transfer state is set to enable transfer of control information to the ECU 61 via the throttle/shift control 22A; and, as illustrated in the fifth row, when the communication state is abnormal, the transfer state is set to disable transfers of control information to the ECU 61 via the throttle/shift control 22A. In other embodiments, the routing information may comprise any number of suitable communication states and destinations.

The memories 224A and 225A may comprise suitable memory devices as described above with reference to the memories 212A and 213A. The memories 224A and 225A may be implemented as separate memory devices, or the memories 224A and 225A may be implemented as different storage blocks in a single memory device.

Preferably, the throttle/shift control 22A determines whether its communication state is normal or abnormal using at least some of the criteria as described above with reference to the start/stop control 21A. Consequently, the throttle/shift control 22A outputs control signals to the primary bus 141 when the throttle/shift control 22A determines that its communication state is normal and outputs control signals to the local bus 143A when the throttle/shift control 22A determines that its communication state is abnormal. Moreover, when the communication state is normal, the throttle/shift control 22A is advantageously enabled to transfer one or more signals from the steering control 30A to the ECU 61 and one or more signals from the ECU 61 to the steering control 30A. For example, communication from the steering control 30A is advantageously routed from the local bus 143A, through the throttle/shift control 22A, through the primary bus 141, and to the ECU 61. In this example, communication from the ECU 61 is routed from the primary bus 141, through the throttle/shift control 22A, through the local bus 143A, and to the steering control 30A. Thus, the throttle/shift control 22A advantageously relays signals between the local bus 143A and the primary bus 141. In alternative embodiments, the throttle/shift control 22A also transfers signals to and from other controls such as the display 41A, the start/stop control 21A, shift/throttle control 22A or the like.

As illustrated in FIG. 2, the throttle/shift control 22A also comprises a CPU 226A and a transceiver 227A. The CPU 226A advantageously comprises a central processing unit, such as the CPU 214A described above, that manages the operation of the throttle/shift control 22A. For example, the CPU 226A advantageously manages the generation of the control signals on the basis of the active control station information stored in the memory 224A. Additionally, the CPU 226A advantageously changes the destination of control signals on the basis of the routing information stored in the memory 225A. The transceiver 227A is configured to communicate with the primary bus 141 and with the local bus 143A.

As shown in FIG. 2, the throttle/shift control 22B includes at least some of the components corresponding to the components of the throttle/shift control 22A, and like components are labeled with the same numeric identifiers with the suffixes changed from "A" to "B." The components of the throttle/shift control 22B perform the functions described above with reference to corresponding components of the throttle/shift control 22A.

The steering controls 30A and 30B illustrated in FIG. 2 advantageously output respective steering control signals (e.g., steering angle signals) to control the directional orientation of the motor 13, and consequently, to control the direction of the movement watercraft 10. The steering angle sensors 32A and 32B detect the respective positions (e.g., angles) of the steering devices 31A and 31B.

The steering device 31A preferably includes a memory 33A that stores information, such as the information shown in the information block in FIG. 3. In particular, the stored information identifies which of the control station 15A or the control station 15B is authorized (e.g., enabled) to control the watercraft 10. For example, when the information stored in the memory 33A indicates the control station 15A is inactive (e.g., not authorized to control the watercraft 10), the steering device 31A is disabled. In this example, a memory 211B of the steering devices 31B stores information indicating that the steering device 31B is enabled and that the control station 15B is active (e.g., authorized to control the watercraft 10). Preferably, operation of the control station selector 223A or the control station selector 223B changes the active control station information in the memory 33A and the memory 33B, thereby changing the active control station to an inactive status and changing the inactive control station to an active status. In alternative embodiments, other suitable methods can be used to determine whether or not a control station is authorized to operate the watercraft 10.

Preferably, the steering device 31A includes a memory 34A that stores information designating routing information, such as, for example, information that identifies the links available for communication to and from the steering device 31A. For example, FIG. 6 illustrates exemplary routing information stored in an information block in the memory 34A. The top row of FIG. 6 illustrates information representing whether the communication state of the steering device 31A is normal or abnormal. The second row associates the communication link to and from the steering device 31A with the local bus 143A when the communication state is normal, and the third row associates the communication link with the secondary bus 142 when the communication state is abnormal. The fourth and fifth rows associate a transfer state of the steering device 31A with the communication state. In particular, as indicated in the fourth row, when the communication state is normal, the transfer state is set to disable transfers of control information to the ECU 61 via the steering device 31A; and, as illustrated in the fifth row, when the communication state is abnormal, the transfer state is set to enable transfer of control information to the ECU 61 via the steering device 31A. In other embodiments, the routing information may comprise any number of suitable communication states and destinations.

The memories 33A and 34A may comprise suitable memory devices as described above with respect to the memories 212A and 213A. As further discussed above, the memories 33A and 34A may be implemented as separate memory devices, or the memories 33A and 34A may be implemented as different storage blocks in a single memory device.

Preferably, the steering control 30A determines whether its communication state is normal or abnormal using at least some of the criteria as described above with reference to the start/stop control 21A. Consequently, the steering control 30A outputs control signals to the local bus 143A when the steering control 30A determines that its communication state is normal and outputs control signals to the secondary bus 142 when the steering control 30A determines that its communication state is abnormal. Moreover, when the communication state is abnormal, the steering control 30A is advantageously enabled to transfer one or more signals from the controls of control station 15A to the ECU 61 and one or more signals from the ECU 61 to the controls of control station 15A. For example, communication from the throttle/shift control 22A can be rerouted to the local bus 143A, through the steering control 30A, through the secondary bus 142, and to the ECU 61. In this example, communication from the ECU 61 is routed from the secondary bus 142, through the steering control 30A, through the local bus 143A and to throttle/shift control 22A. Thus, the steering control 30A advantageously relays signals between the local bus 143A and the secondary bus 142. In alternative embodiments, the steering control 30A transfers signals to and from other controls such as the display 41A, the start/stop control 21A, shift/throttle control 22A or the like.

As illustrated in FIG. 2, the steering control 30A comprises a CPU 35A and a transceiver 36A. The CPU 35A advantageously comprises a central processing unit, such as the CPU 214A described above, that manages the operation of the steering control 30A. For example, the CPU 35A advantageously manages the generation of the output of the control signals on the basis of the active control station information stored in the memory 33A. Additionally, the CPU 35A advantageously changes the destination of control signals on the basis of the routing information stored in the memory 34A. The transceiver 36A is configured to communicate with the secondary bus 142 and the local bus 143A.

As shown in FIG. 2, the steering control 30B includes at least some of the components corresponding to the components of the steering control 30A, and like components are labeled with the same numeric identifiers with the suffixes changed from "A" to "B." The components of the steering control 30B perform the functions described above with reference to corresponding components of the steering control 30A.

The displays 41A and 41B illustrated in FIG. 2 are display devices, such as, for example, cathode ray tubes (CRTs), liquid crystal displays (LCDs), or the like, that provide many types of information useful to the operator of the watercraft.

The display 41A communicates with the ECU 61 via the primary bus 141. The display 41A may also communicate with the ECU 61 via the local bus 143A, the steering control 30A and the secondary bus 142.

The display 41A advantageously includes memory (not shown) similar to the memory 213A. The display 41A determines whether its communication state is normal or abnormal using at least some of the criteria as described with reference to the start/stop control 21A. Consequently, the display 41A outputs control signals to the primary bus 141 when the display 41A determines that its communication state is normal and outputs control signals to the local bus 143A when the display 41A determines that its communication state is abnormal.

The display 41B is configured similar to the display 41A. The display 42B communicates with the ECU 61 directly via the primary bus 141 or via the local bus 143A, the steering control 30A and the secondary bus 142.

The ECU 61 illustrated in FIG. 2 controls the motor 13 by generating actuation commands to control devices within the motor 13. The ECU 61 advantageously includes a central processing unit or CPU (not shown), a memory device (not shown), such as, for example, RAM, ROM, or the like, an auxiliary memory device (not shown), such as, for example, nonvolatile RAM, a hard disk, a CD-ROM or an optical magnetic disk, or the like, and a clock (not shown) or the like.

Preferably, the ECU 61 includes memory (not shown) that stores information designating routing information, such as, for example, information that identifies the links available for communication to and from the ECU 61. For example, FIG. 7 illustrates exemplary routing information stored in an information block in the memory of the ECU 61. The top row of FIG. 7 illustrates information representing whether the communication state of the ECU 61 is normal or abnormal. The second row associates the communication link to and from the ECU 61 with the primary bus 141 when the communication state is normal, and the third row associates the communication link with the secondary bus 142 when the communication state is abnormal. The memory may comprise any suitable memory as described with reference to the memory 213A. In other embodiments, the routing information may comprise any number of suitable communication states and destinations.

Preferably, the ECU 61 determines whether its communication state is normal or abnormal using at least some of the criteria as described above with reference to the start/stop control 21A. Consequently, the ECU 61 outputs signals to the primary bus 141 when the ECU 61 determines that its communication state is normal and outputs control signals to the secondary bus 142 when the ECU 61 determines that its communication state is abnormal.

Preferably, the motor 13 includes an engine (not shown), such as, for example, an internal combustion engine that generates power by igniting an air/fuel mixture in at least one combustion chamber. The power generated by the engine is coupled to a propeller via a power train (not shown) to cause the propeller to rotate and produce propulsive force (e.g., thrust) to move the watercraft 10. The ECU 61 responds to the start/stop signal from one of the start/stop controls 21A and 21B to start the engine when the engine is stopped and to stop the engine when then engine is running. The engine advantageously includes a throttle (not shown) that controls an amount of a fuel/air mixture fed into at least one combustion chamber (not shown). The power train advantageously includes a shifter (not shown) that is operated to change the transmission of power from the engine to the propeller. The shifter may be moved to a neutral position to halt the generation of thrust even with the engine running; moved to a forward position to cause the propeller to apply forward thrust to the watercraft 10; and moved to a reverse position to cause the propeller to apply rearward thrust to reverse the watercraft 10.

Preferably, the throttle-opening sensor 71 detects the state of the engine throttle (e.g., a degree of opening from fully closed to wide open) and outputs the detected throttle-opening information. The shift position sensor 72 detects the state (e.g., position) of the shifter of the power train and outputs the detected shift position information. The steering angle sensor 73 detects the direction (e.g., angle) of the motor 13 relative to the hull 12 and outputs the detected steering angle information. The throttle actuator 81 operates the engine throttle on the basis of the throttle opening signal from the shift throttle units 22A and 22B. The shift actuator 82 operates the shifter of the power train on the basis of the shift position signal from the shift throttle units 22A and 22B. The steering actuator 83 changes the direction of the motor 13 on the basis of the steering angle signal from the steering controls 30A and 30B.

Figure 8A:
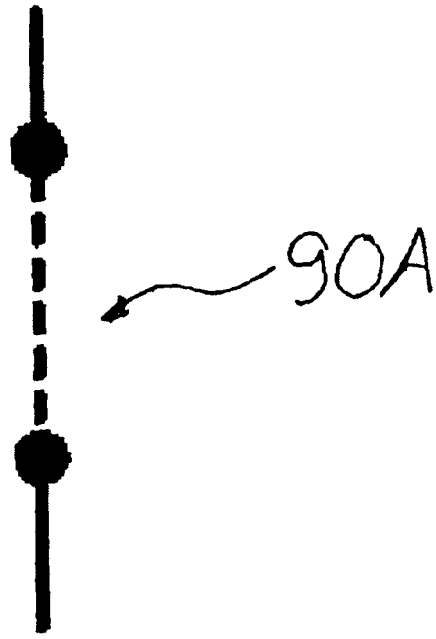
FIG. 8, comprising FIG. 8A and FIG. 8B, pictorially illustrates exemplary causes of abnormal communication states that are detectable by the control system of FIG. 2.
Figure 8B:
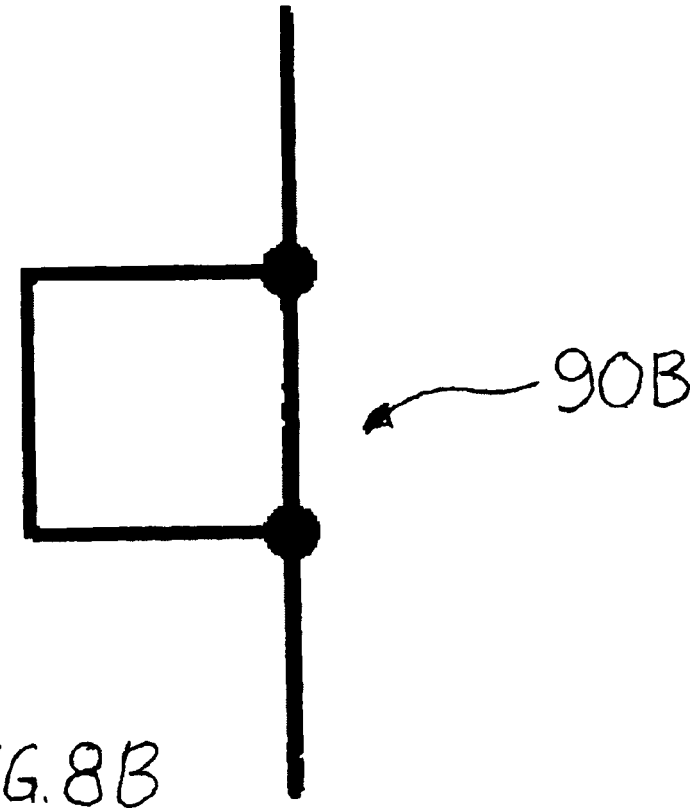

In the embodiment illustrated in FIG. 2, the control system 11 advantageously switches the communication link between the watercraft control devices and the motor 13 in any suitable situation. In particular, the control system 11 switches communication links when an abnormal condition affects a communication link in the control system 11. Abnormalities in an active communication link may adversely affect communication within the control system 11, and cause improper operation of the motor 13. Switching communication links may restore the control system 11 to proper operation. FIG. 8A and FIG. 8B illustrate two examples of possible abnormal conditions that may occur in a communication link.

FIG. 8A illustrates an open state in a bus 90A. When the bus 90A is open, communication between the watercraft control devices and the motor 13 is either disrupted or does not occur. In particular, signals from the motor 31 are not received by the watercraft control devices, and signals from the watercraft control devices are not received by the motor.

FIG. 8B illustrates a shorted state in a bus 90B. When the bus 90B is shorted, signals are branched and transferred. A particular signal may arrive at a destination at staggered times because of the branching. The staggered arrival times may cause distortion of the received signal. Alternatively, when the bus 90B is shorted, a signal will not arrive at or be detectable at a destination.

While switching in response to an abnormal condition is illustrated below, the system may switch for other suitable purposes in response to other conditions.

In the illustrated embodiment, the watercraft control devices and the ECU 61 are able to communicate via communication links, such as, the primary bus 141, the secondary bus 142, and the local buses 143A and 143B. Accordingly, when an abnormal communication occurs in either the primary bus 141 or secondary bus 142, communication using an unaffected link may be continued. Thus, the control system 11 advantageously includes redundant communication channels and an active routing mechanism that route around network problems.

When no abnormality exists in the communication link between the watercraft control devices and the ECU 61, communication is in the normal state. When in the normal state, communication is generally performed via the primary bus 141. For example, in the primary control station 15A, the start/stop control 21A, the throttle/shift control 22A, and the display 41A include input/output terminals coupled to the primary bus 141 to enable communication with the ECU 61. When communication is in the normal state, control signals from start/stop control 21A, the throttle/shift control 22A, and the display 41A are outputted from the primary control station 15A when the primary control station 15A has authorization to operate the watercraft 10. In this example, the steering control 31A outputs a control signal to the local bus 143A. The control signal is received at the throttle/shift control 22A. The throttle/shift control 22A then transfers the control signal onto the primary bus for communication to the ECU 61. Additionally, a signal from the ECU 61 to the steering control 30A is received at the throttle/shift control 22A. The throttle/shift control 22A transfers the signal onto the local bus 143A for communication to the steering control 30A. Thus, the throttle/shift controls 22A relays signals between the local bus 143A and the primary bus 141.

When the secondary control station 15B is enabled, the components of the secondary control station 15B perform the functions described above with reference to corresponding components of the primary control station 15A when communication is the normal state. Regardless of which control station is enabled, when communication is in the normal state, the secondary bus 142 is not used for communication in the preferred embodiment described herein. Thus, any abnormality in the secondary bus 142 does not affect the communication via the primary bus 141.

When an abnormality occurs in the communication link between the watercraft control devices and the ECU 61, the communication state changes to abnormal state. If the primary bus 141 is unable to communicate to the ECU 61 in this abnormal state, communication is maintained by switching the communication link to the secondary bus 142. One skilled in the art will appreciate that when the secondary bus 142 is being used as the communication link and an abnormal state occurs, the communication link is advantageously switched to the primary bus 141.

Figure 9:
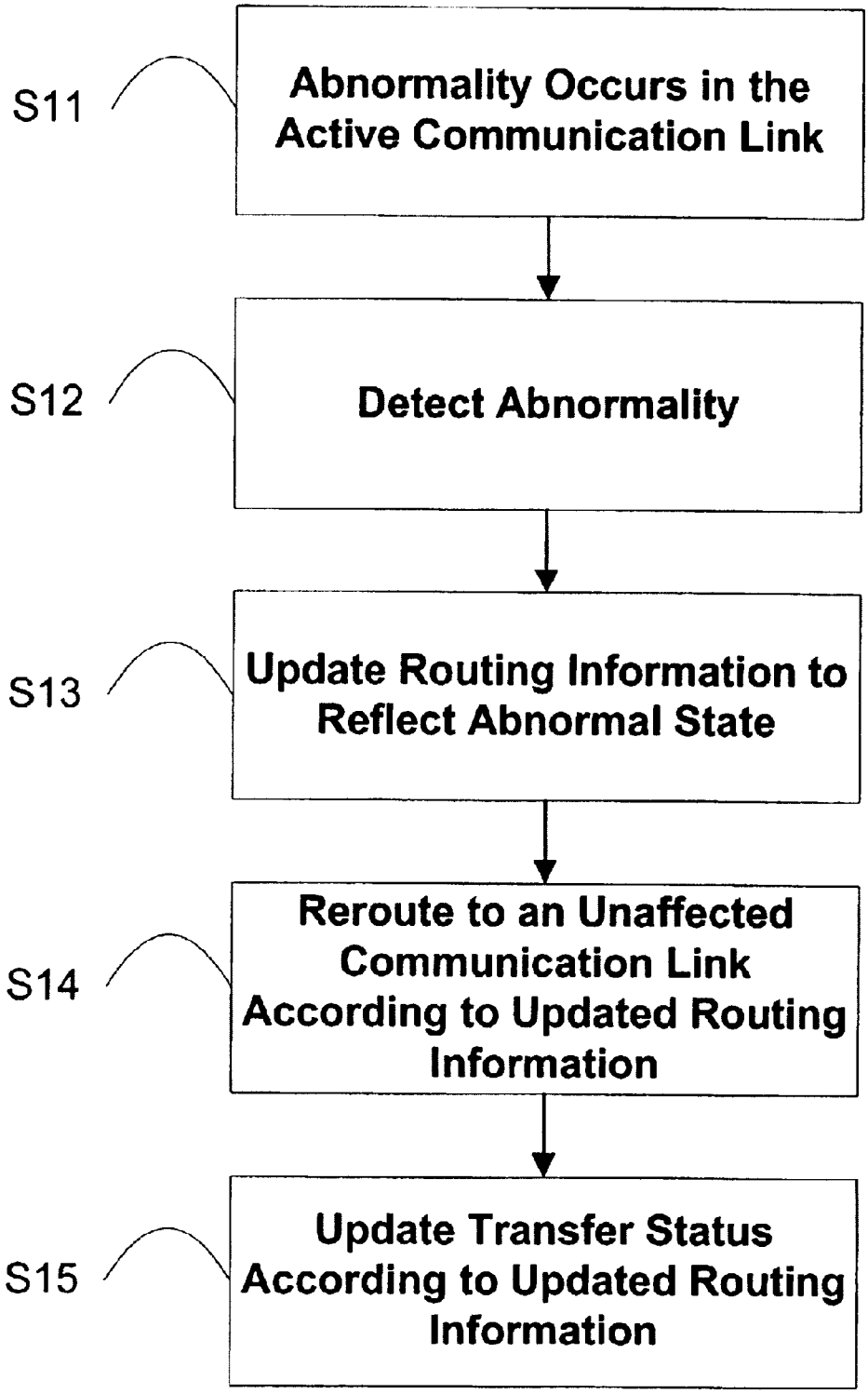
FIG. 9 is a flow chart illustrating an abnormality detection and communication rerouting process in accordance with an embodiment of the invention.

FIG. 9 illustrates an abnormality detection process in accordance with an embodiment of the invention. In a state S11, an abnormality (e.g., a signal not received, a distorted signal, or the like) occurs in the active communication link. For illustration, it is assumed that the primary bus 141 is the active communication link.

In a state S12, the abnormality is detected by at least one node in the LAN 14. For example, an abnormality in a signal from the ECU 61 may be detected at the start/stop control 21A, at the throttle/shift control 22A, at the steering control 30A, or at the display 41A. Similarly, an abnormality in a signal from at least one of watercraft control devices may be detected at the ECU 61. As discussed above, the nodes that detect the abnormality preferably have memories that store information designating routing information. In particular, the memories store information representing whether the communication state of the node is normal or abnormal.

In a state S13, the nodes that detect the abnormality update the routing information stored in their respective memories to indicate that their respective communication states are abnormal.

In a state S14, the nodes reroute their communication to the communication links associated with the new communication state. For example, the start/stop control 21A and the throttle/shift control 22A switch communication from the primary bus 141 to the local bus 143A. The steering control 30A switches communication from the local bus 143A to the secondary bus 142. If the display 41A has a memory that stores routing information, the display 41A switches communication from the primary bus 141 to the local bus 143A. Additionally, the ECU 61 switches communication from the primary bus 141 to the secondary bus 142.

In a state S15, any nodes that transfer (e.g., relay) communication to and from other nodes preferably update their transfer status (e.g., enabled or disabled) to the transfer status associated with the new communication state.

For example, the transfer state is switched in the throttle/shift control 22A and the steering control 30A when the information of the communication states in their respective memories is changed to abnormal. In this example, the throttle/shift control 22A disables (e.g., stops) the transfer process to and from the ECU 61 via the primary bus 141, and the steering control 30A enables (e.g., begins) the transfer process to and from the ECU 61 via the secondary bus 142.

Consequently, when operating in the abnormal state, the control signals that the display 41A, the start/stop control 21A and the throttle/shift control 22A output to the local bus 143A are relayed to the secondary bus 142 by the steering control 30A and are thereby coupled to ECU 61. Similarly, the signals transmitted from the ECU 61 to the start/stop control 21A, the throttle/shift control 22A, and the display 41A are relayed via the steering control 30A. Thus, the steering controls 30A functions as the relay device for the signals between the start/stop control 21A and the ECU 61, for the signals between the throttle/shift control 22A and the ECU 61, and for the signals between the display 41A and the ECU 61.

A similar switch in the communication link occurs when the secondary control station 15B is enabled and an abnormality is detected.

In the illustrated embodiment, each node detects an abnormality and updates its own communication routing information. In another embodiment, one node detects an abnormality, updates its own communication routing information and the communication routing information of at least some of the other nodes. For example, the detecting node may advantageously transmit information identifying the occurrence of the abnormality to at least some of the nodes, or it may advantageously transmit its own communication routing information to the other nodes. In a further embodiment, the detecting node may advantageously transmit the information to the primary control station 15A, to the secondary control station 15B, or to both control stations.

Figure 10:
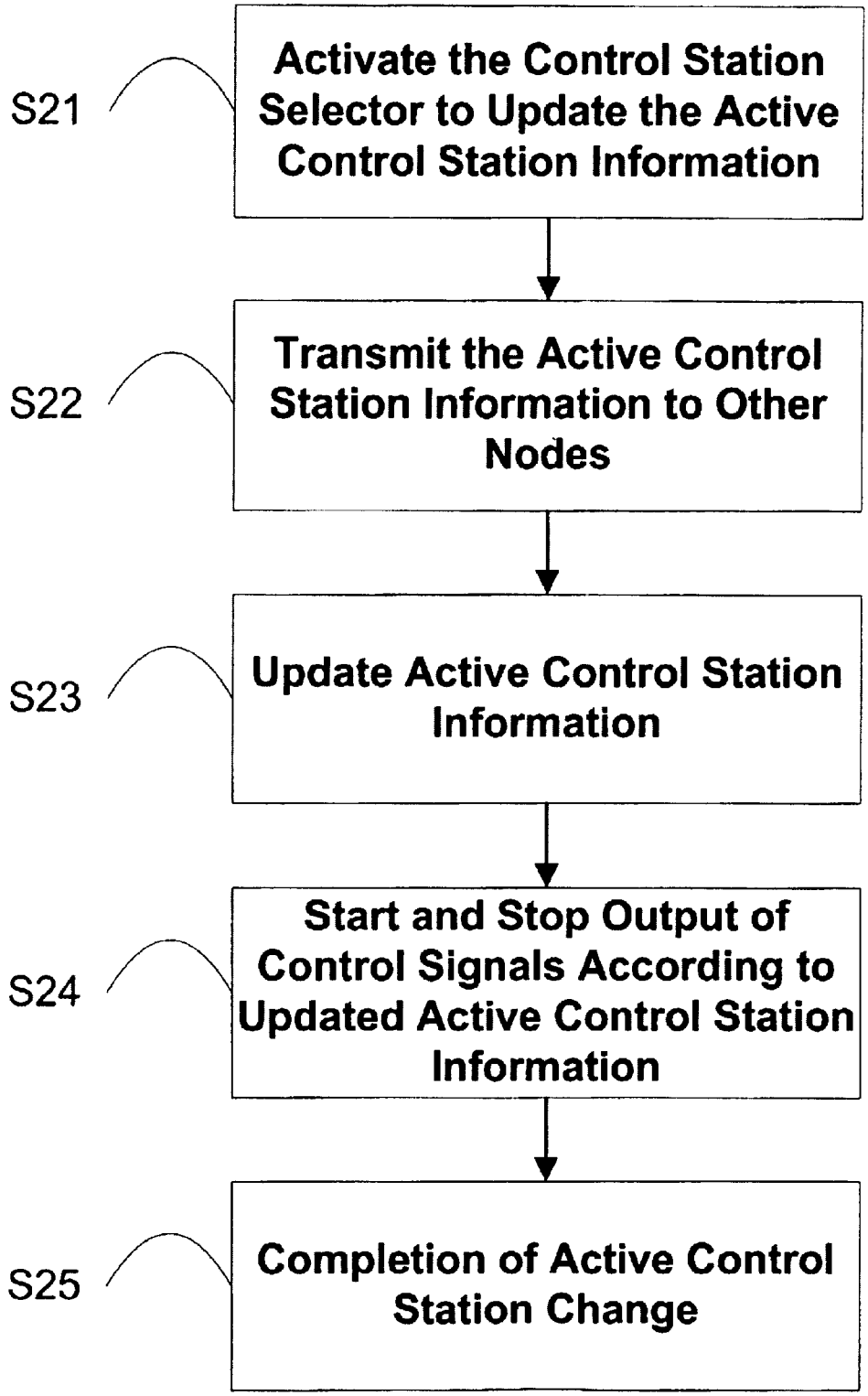
FIG. 10 is a flow chart illustrating a process for switching control station authorization in accordance with an embodiment of the invention.

FIG. 10 illustrates a process for switching the control station enabled or authorized to operate the watercraft in accordance with an embodiment of this invention. As illustrated, authorization is controlled by the control station selectors 223A and 223B.

In a state S21, one of the control station selectors 223A and 223B is activated. For illustration, it is assumed that the control station selector 223B in the throttle/shift control 22B of the secondary control station 15B has been activated to select the secondary control station 15B as the authorized control station.

In a state S22, the active control station information is transmitted from the throttle/shift control 22B to the other nodes. For example, in one embodiment, the active control station information stored in the memory 224B is updated to reflect that the secondary control station 15B is active and that the primary control station 15A is inactive. The throttle/shift control 22B advantageously transmits the active control station information to the throttle/shift control 22A via the primary bus 141, to the start/stop control 21B via the local bus 143B, to the display 41B via the local bus 143B, and to the steering control 30B via the local bus 143B. Upon receipt of the active control station information, the throttle/shift control 22A of the primary control station 15A transmits the received active control station information via the local bus 143A to the controls of the primary control station 15A, such as, the start/stop control 21A, the display 41A and the steering control 30A. Consequently, the controls at primary control station 15A and secondary control station 15B all receive the same active control information. In another embodiment, the throttle/shift control 22B transmits the active control station information to at least one of the controls of the primary control station 15A via the primary bus 141. In another embodiment, the throttle/shift control 22B transmits the active control station information to at least one of the controls of the secondary control station 15B via the primary bus 141. In another embodiment, the transmitted active control station information directly identifies a particular control station that has the right of operation. In another embodiment, the transmitted active control station information indirectly identifies the control station. For example, when there are two control stations, the transmitted active control station information may send information indicating a change of the control station that is currently identified. A skilled artisan will recognize in view of this disclosure a number of suitable set of rules or information that may be used to determine whether a control station change should be made.

In a state S23, after the active control station information has been received, the nodes update the active control station information in their respective memories to reflect that the secondary control station 15B is active and that the primary control station 15A is inactive.

In a state S24, the outputting of the control signals from the primary control station 15A stops (e.g., the primary control station 15A is disabled) and the outputting of the control signals from the secondary control station 15B begins (e.g., the secondary control station 15B is enabled). In this example, the control signals generated by the start/stop control 21A, the throttle/shift control 22A, and the steering control 30A are no longer communicated to the ECU 61, and the control signals generated by the start/stop control 21B, the throttle/shift control 22B, and the steering control 30B are communicated to the ECU 61. In a state S25, the switching of authorization is complete.

Because the control signals are transmitted from the control station with the right to operate the watercraft, the controls do not send competing, contradictory signals and the watercraft properly operates.

While a plurality of buses in the control system 11 are illustrated, the LAN 14 may advantageously comprise other suitable combinations of network topologies, including, but not limited to, bus, star, ring, and tree topologies, and may comprise any suitable combination of inboard and outboard networks. Any suitable type of communication links may be provided, including, but not limited to, a combination of wireless or wired links. Additionally, three or more communication links may be provided.

Figure 11:
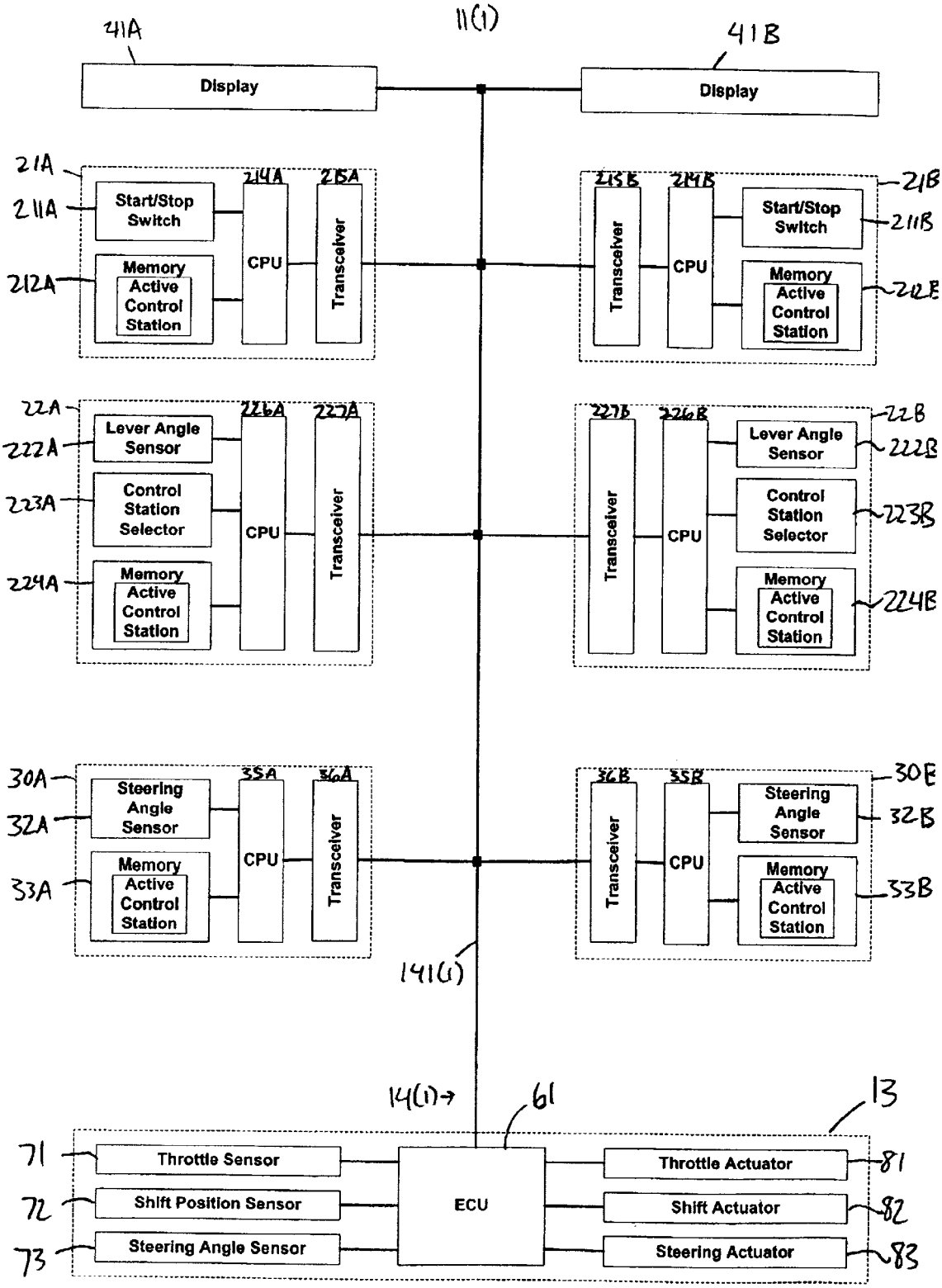
FIG. 11 is a block diagram of an alternative embodiment of a control system similar to FIG. 2 wherein the system provides multiple control stations but not multiple communication links.

Although FIG. 2 illustrates an embodiment in which both the active control station and the communication link are switched, these functions may performed independently. For example, FIG. 11 illustrates an embodiment in which only the active control station is switched. An inboard LAN system 11(1) illustrated in FIG. 11 communicates between the watercraft control devices and the motor 13 through the primary bus 141(1). In this case, the update of the active control station information at the state S23 in FIG. 10 is performed through the primary bus 141(1).

Figure 12:
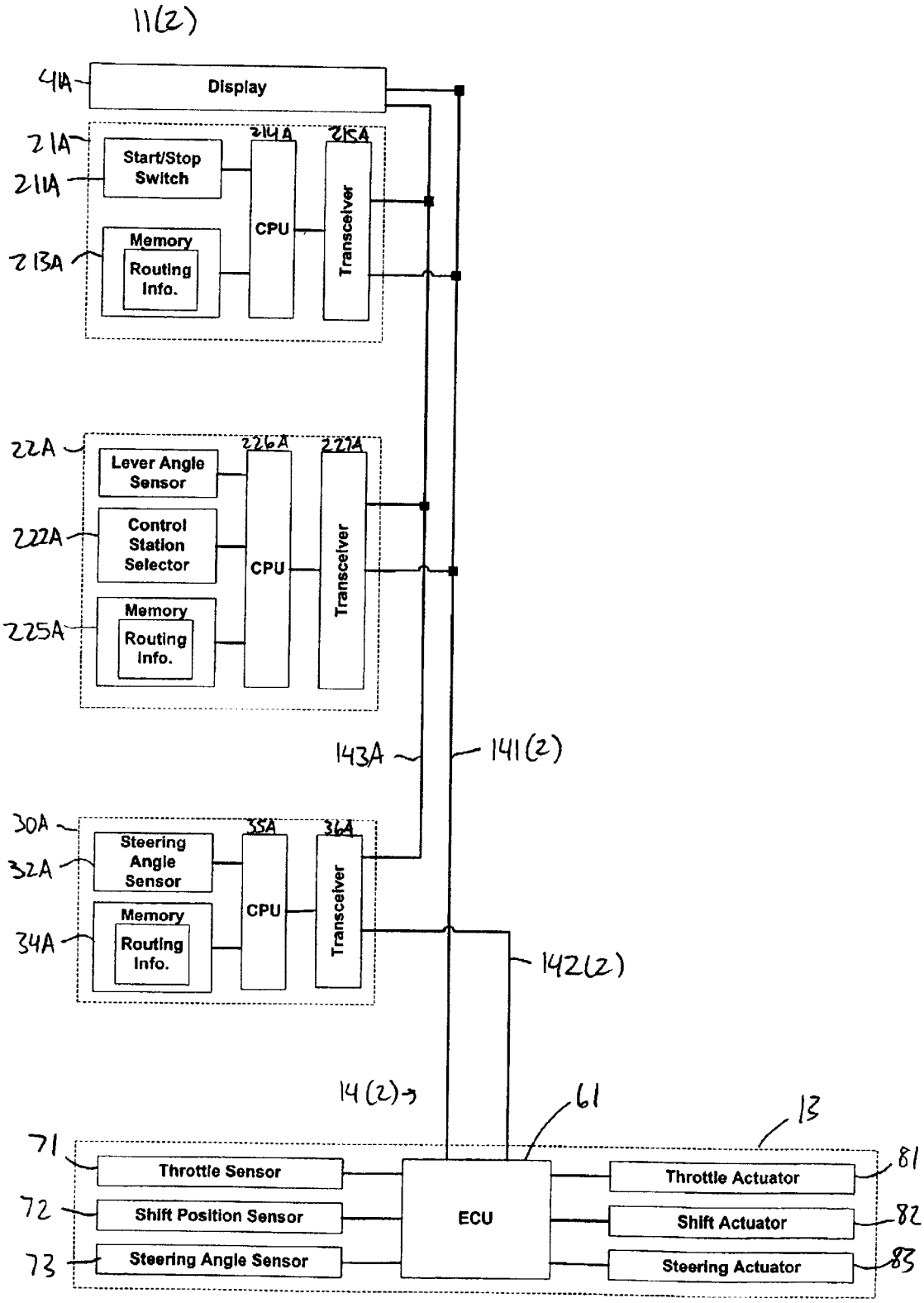
FIG. 12 is a block diagram of an alternative embodiment of a control system similar to FIG. 2 wherein the system provides multiple communication links but not multiple control stations.

As another example, FIG. 12 illustrates an embodiment in which only the communication link is switched. A control system 11(2) illustrated in FIG. 12 is used where a watercraft has one control station, and, thus, does not have a secondary control station 15B or the control station selector.

As illustrated above, the switching of authorization operate the watercraft may be between two control stations. However, in other embodiments, the switching of authorization to operate the watercraft may be between three or more control stations. In such case, the active control station information input by one control station can advantageously be transmitted to all the other control stations so that the transmission of the operation information from the other control stations can be disabled. In a further alternative embodiment, the LAN system advantageously comprises a primary bus and multiple secondary buses, wherein communication through the primary bus and a secondary bus are performed in the normal state, and communication through the unaffected buses is performed in the abnormal state to improve communication efficiency.

As illustrated above, an abnormality in communication may be detected in each unit to switch the communication link in a distributed fashion. However, other suitable methods of detecting an abnormality may be used. For example, a communication abnormality may be detected by any node, which then transmits a command to the other nodes (e.g., centralized detection). In this example, this command may be advantageously transmitted and received via a bus unaffected by the abnormality.

As illustrated above, abnormal communication is detected in primary bus. However, in other embodiments, an abnormal communication may be detected in any of the communication links, such as, for example, in the primary bus, in the secondary bus, or in both buses.

Although the foregoing invention has been described in terms of certain preferred embodiments, other embodiments will be apparent to those of ordinary skill in the art from the disclosure herein. Additionally, other combinations, omissions, substitutions and modifications will be apparent to the skilled artisan in view of the disclosure herein. Accordingly, the present invention is not intended to be limited by the reaction of the preferred embodiments, but is to be defined by reference to the appended claims.

What is claimed is:

1. A watercraft control system for controlling a watercraft having a motor and having multiple control stations, the watercraft control system comprising:

a first control station comprising:

at least one memory that stores authorization information designating whether the first control station is authorized to control the watercraft; and a first set of operational controls that output one or more operational control signals when the first control station is authorized to control the watercraft;

a second control station comprising:

at least one memory that stores authorization information designating whether the second control station is authorized to control the watercraft; and a second set of operational controls that output one or more operational control signals when the second control station is authorized to control the watercraft; and and a motor controller that receives operational control signals from the authorized one of the first control station and the second control station and that controls the motor in response to the operational control signals.

2. The watercraft control system of claim 1, wherein, when the authorization information stored in the at least one memory of the second control station designates authority for the first control station to operate the watercraft, the second control station disables the output of the one or more operational control signals of the second set of operational controls.

3. The watercraft control system of claim 1, wherein, when the authorization information stored in the at least one memory of the first control station designates authority for the second control station to operate the watercraft, the first control station disables the output of the one or more operational control signals of the first set of operational controls.

4. The watercraft control system of claim 1, wherein the first set of operational controls includes a start/stop control.

5. The watercraft control system of claim 1, wherein the first set of operational controls includes a throttle/shift control.

6. The watercraft control system of claim 1, wherein the first set of operational controls includes a steering control.

7. The watercraft control system of claim 1, further comprising:

a first communication link that provides communication of the operational control signals of the controls of the control stations; and a second communication link that provides communication of the operational control signals of the controls of the control stations.

8. The watercraft control system of claim 7, wherein when at least one operational control in the first set of operational controls receives an abnormal signal via the first communication link and switches communication to the second communication link in response to the receipt of the abnormal signal.

9. A watercraft motor control system that routes communication around improperly operating communication links in a watercraft having a motor, the watercraft control system comprising:

a first set of controls that outputs signals;

an electronic control unit (ECU) in the motor, the ECU receiving the signals and controlling the motor in response to the signals;

a first communication link that couples the signals from the first set of controls to the ECU during normal communication conditions; and a second communication link that selectively couples the signals from the first set of controls to the ECU when a control in the first set of controls determines that communication to or from the ECU via the first communication link is abnormal and switches communication to the second communication link.

10. The watercraft control system of claim 9, wherein communication via the first communication link is between the first set of controls.

11. The watercraft control system of claim 9, wherein the first communication link comprises a bus network.

12. The watercraft control system of claim 9, wherein communication via the second communication link is among the first set of controls.

13. The watercraft control system of claim 9, wherein the second communication link comprises a local bus network and a secondary bus network.

14. The watercraft control system of claim 9, wherein the first set of controls includes at least one memory that stores routing information.

15. The watercraft control system of claim 14, wherein the routing information includes routing instructions when communication is normal and routing instructions for when communication is abnormal.

16. The watercraft control system of claim 10, further comprising a second set of controls that communicate with the ECU via the first communication link or via the second communication link.

17. The watercraft control system of claim 16, further comprising at least one memory that stores authorization information to designate either the first set of controls or the second set of controls as being authorized to communicate signals to operate the watercraft.

18. A method of authorizing one of a plurality of sets of controls for a watercraft having a first control station and a second control station, the method comprising:

receiving electronic data identifying one of the plurality of sets of controls authorized to operate a watercraft;

storing the data;

determining, based on the stored data, whether a received operation control signal from the plurality of sets of controls is from the authorized one of the plurality of sets of controls; and operating the watercraft when the received operation control signal corresponds with the authorized one of the plurality of sets of controls.

19. A watercraft control system for routing communication, the system comprising:

a watercraft operational control coupled to two or more communication links; and a memory that identifies one of the two or more communications links as active when an abnormality is detected in another of the two or more communication links.

20. A method for routing communication in a watercraft control system, the method comprising:

detecting an abnormality in a first communication link coupled to one or more watercraft controls;

storing information indicating that an abnormality has occurred in the first communication link; and routing communication to a second communication link on the basis of the information.

* * * * *

UNITED STATES PATENT AND TRADEMARK OFFICE

CERTIFICATE OF CORRECTION

PATENT NO. : 7,108,570 B2
APPLICATION NO. : 10/293403
DATED : September 19, 2006
INVENTOR(S) : Takashi Okuyama It is certified that error appears in the above-identified patent and that said Letters Patent is hereby corrected as shown below:

In Column 1, Line 2, please delete "Shizouka" and insert -- Shizuoka --, therefore.

In Column 2, Line 1, please delete "Jesus" and insert -- Jesús --, therefore.

In Column 2, Line 8, please delete "Electronics" and insert -- Electronic --, therefore In Column 2, Line 16, please delete "10,281,390," and insert -- 10/281,390, --, therefore.

In Column 17, Line 44, Claim 1, before "a motor" please delete "and".

Signed and Sealed this

Nineteenth Day of June, 2007

JON W. DUDAS
*Director of the United States Patent and Trademark Office*